US005272985A

United States Patent [19]

Drexel et al.

[11] Patent Number: 5,272,985

[45] Date of Patent: Dec. 28, 1993

[54] APPARATUS FOR TRANSPORTING WORKPIECES

[75] Inventors: Peter Drexel, Steinenbronn; Gernot Maier, Stuttgart; Rainer Utz, Waiblingen; Hans-Jochen Kollek, Illingen; Hans Erne, Waiblingen; Peter Rothfuss, Ditzingen; Thomas Schmid, Ludwigsburg; Ulrich Mueller, Korb, all of Fed. Rep. of Germany

[73] Assignee: Robert Bosch GmbH, Stuttgart, Fed. Rep. of Germany

[21] Appl. No.: 834,234

[22] PCT Filed: Aug. 16, 1991

[86] PCT No.: PCT/DE91/00649

§ 371 Date: Feb. 18, 1992

§ 102(e) Date: Feb. 18, 1992

[87] PCT Pub. No.: WO92/03363

PCT Pub. Date: Mar. 5, 1992

[30] Foreign Application Priority Data

Aug. 18, 1990 [DE] Fed. Rep. of Germany ..... 4026227

[51] Int. Cl.[5] ..... B65G 37/00

[52] U.S. Cl. ..... 104/102; 104/130

[58] Field of Search ..... 104/48, 56, 96, 102, 104/130

[56] References Cited

U.S. PATENT DOCUMENTS

| | | | |
|---|---|---|---|
| 3,901,160 | 8/1975 | Auer | 104/96 |
| 4,899,865 | 2/1990 | Keil | 198/351 |
| 5,044,283 | 9/1991 | Marie et al. | 104/48 |
| 5,154,123 | 10/1992 | Loomer | 104/96 |

FOREIGN PATENT DOCUMENTS

| | | | |
|---|---|---|---|
| 269742 | 3/1969 | Austria . | |
| 0365446 | 4/1990 | European Pat. Off. | 104/102 |
| 1534011 | 2/1969 | Fed. Rep. of Germany . | |
| 2241789 | 9/1973 | Fed. Rep. of Germany . | |
| 8810077 | 11/1988 | Fed. Rep. of Germany . | |
| 1549651 | 11/1968 | France | 104/102 |

*Primary Examiner*—Mark T. Le

*Attorney, Agent, or Firm*—Spencer, Frank & Schneider

[57] ABSTRACT

In apparatuses of the generic type, single point modules are provided which can transfer only the transport wagons arriving from one point branch optionally into one of the two other point branches. It is achieved by the development of the point modules according to the invention as T-shaped double point modules (40) that each point branch (42, 44, 46) can be connected optionally to one of the other two point branches, which results in a construction of a network transport path system of a simpler construction which requires less space and provides a better overview. For narrowing the spacing of parallel transport path routes (76, 80), point modules (72) are proposed whose branch angle is less than 90°, preferably 45°. Apparatus with flexible transport path and assembly systems in industrial production plants are a preferred application sector.

3 Claims, 3 Drawing Sheets

APPARATUS FOR TRANSPORTING WORKPIECES

BACKGROUND OF THE INVENTION

The invention relates to an apparatus for transporting workpeices. The apparatus includes a transport path (track) system for transport wagons (carriages). The transport path system which passes by workplaces, is composed of route modules and point (switching) modules, each provided with running surfaces for the transport wagons and support surfaces for the lateral guidance of the wagons. In the point modules the lateral guidance is effected by guide elements, such as rotatably mounted rollers which are arranged on the opposite transport wagon sides that are oriented parallel to the plane of the transport path. The guide elements are perpendicular to the plane of the running surfaces and engage in guides of the point modules. The engagement on a side of the transport wagon parallel to the transport path is discontinued by changing the setting of the guide elements at the point module and/or on the transport wagons from an operative position determining the direction of travel to an inoperative, lateral position. In a known apparatus of this generic type, the transport path system is provided with simple point modules, on which only the transport wagons arriving on one of the two coaxially opposite point branches can optionally be transferred into the coaxially opposite point branch or into the point branch which is diverted at a right an design requires additional point connections to make it possible for the travel paths of the transport wagons to be fixed in an as flexible and optimum manner as possible in a network transport path system.

SUMMARY OF THE INVENTION

It is an object of the invention to provide an improved transport path system of the above-outlined type from which the discussed disadvantages are eliminated.

This object and others to become apparent as the specification progresses, are accomplished by a first embodiment of the invention, according to which, briefly stated, the transporting apparatus includes a wagon and a transport path system for guiding the wagon. The transport path system includes first and second longitudinally aligned, mutually spaced route modules defining a first travel path; third and fourth longitudinally aligned, mutually spaced route modules defining a second travel path; and a point module assembly coupling the first, second, third and fourth route modules to one another and having switchable guide elements for routing the wagon. The point module assembly includes a first T-shaped double point module having two opposite point branches coupled tot he first and second route modules, respectively and a diverted point branch extending at an angle from the opposite point branches. The point module assembly further has a second T-shaped double point module including two opposite point branches coupled to the third and fourth route modules, respectively; and a diverted point branch extending at an angle from the opposite point branches of the second T-shaped double point module and having an end arranged face-to-face to an end of the diverted point branch of the first T-shaped double point module.

Objects of the invention are further accomplished by a second embodiment of the invention according to which, briefly stated, the transport path system includes first and second longitudinally aligned, mutually spaced route modules; a third route module spaced from the first and second route modules and extending parallel thereto; and a point module assembly coupling the first, second and third route modules to one another for causing the wagon to travel from the first route module to the second route module through the point module assembly or for causing the wagon to travel from the first route module to the third route module through the point module assembly. The point module assembly includes a point module having two opposite ends coupled to the first and second route modules, respectively; a first, linear wagon-guiding strip extending between the opposite ends and being switchable between an operative and an inoperative position; and a second wagon-guiding strip extending from the first route module to an additional end of the point module. The second wagon-guiding strip has, at the additional end, a direction forming an angle of less than 90° with the first wagon-guiding strip. The second wagon-guiding strip includes a curved strip portion switchable between an operative and an inoperative position. The point module assembly further has a counter-arc module having a first end arranged face-to-face with the additional end of the point module; a second end connected to the third route module; and wagon-guiding strips defining a curved travel path from the first end of the counter-arc module to the third route module.

The arrangement according to the invention has the advantage that, with an optimum selection of travel paths, additional point connections are not required and the transport path system can be planned and constructed in a simpler manner which requires less space and provides a better overview. The T-shaped double point module according to the invention is a universal component which allows two mutually approaching transport path routes to be joined together and led into a route diverted at a right angle, and allows one transport path route to branch into two routes diverging at a right angle.

It is particularly advantageous for the transport path system to have at least at one junction two T-shaped double point modules which are joined together by their diverted point branches. By this means, four transport path routes can be connected to one another in the smallest space in such a way that transport wagons from each of the four transport path routes can travel without stopping in each of the three other routes.

For the mechanical construction of a T-shaped double point module a design is proposed which is known per se and in which the guide grooves are provided on the point module in guide strips which can be displaced or swivelled from an operating position into a non-functional side position.

In a further embodiment of the invention the transport path system comprises at least one point module with a branch angle of less than 90°, preferably 45°, and preferably comprises at least one counter-arc module, the arc angle of which corresponds to the branch angle of this one point module. With point modules and counter-arc modules constructed in this way, space-saving solutions can be achieved in respect of parallel and passing routes.

DESCRIPTION OF THE PREFERRED EMBODIMENTS

Figure 1:
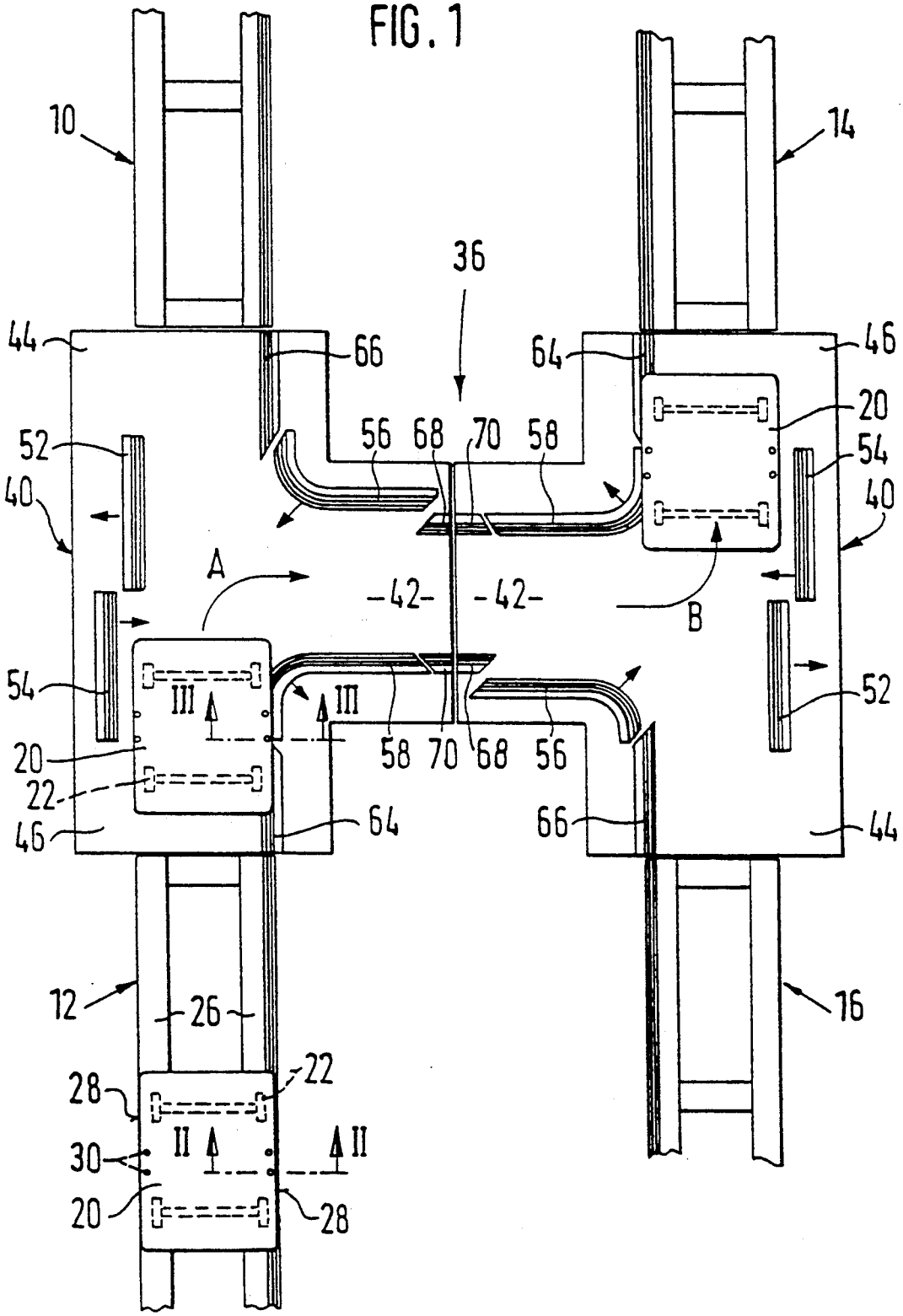
FIG. 1 is a top plan view of a first preferred embodiment, showing a junction of four transport path routes implemented by two T-shaped double point modules.
Figure 2:
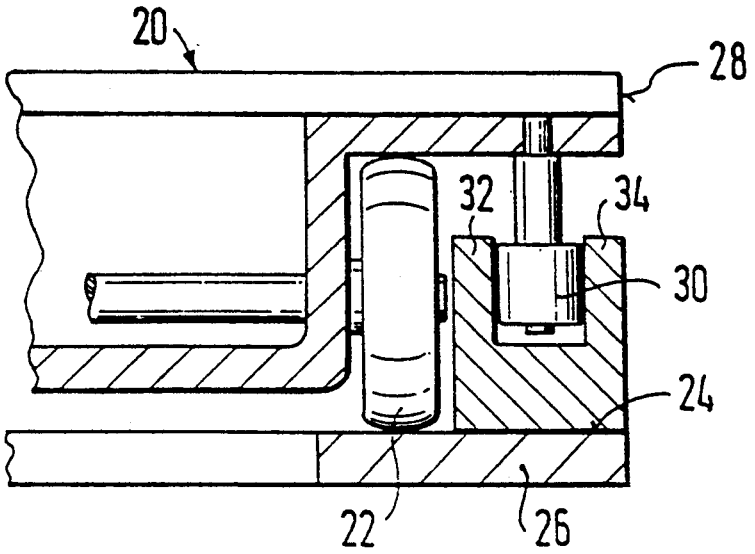
FIG. 2 is a sectional view taken along line II—II of FIGS. 1 and 4.
Figure 3:
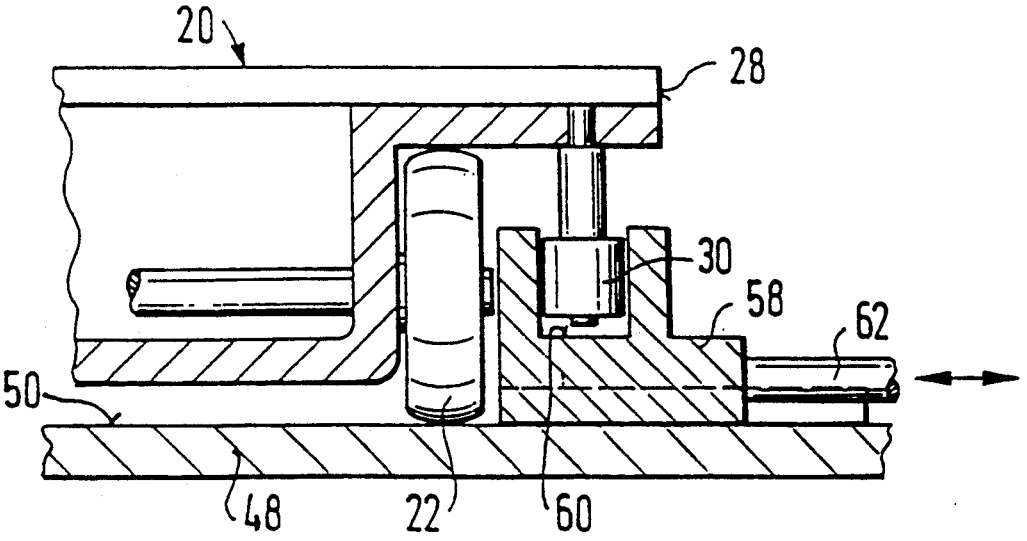
FIG. 3 is a sectional view taken along line III—III of FIG. 1.

The transport path system according to FIGS. 1 to 3 has four transport path routes 10, 12, 14, 16, which are constructed as individual modules or are composed of individual modules, for transport wagons 20, which are each provided with their own drive. The latter can preferably be fed from an accompanying battery and/or from supply lines integrated in the transport path routes. Each transport wagon 20 has four running wheels 22 which rest on flat running surfaces 24 (FIG. 2) of transport path supports 26, arranged parallel to one another, of the individual transport path routes. For the lateral guiding of the transport wagons 20, the latter are provided on their longitudinal edges 28 parallel to the path in each case with two guide rollers 30 which are mounted rotatably perpendicular to the plane of the running surfaces and which extend between parallel guide strips 32, 34 which are attached to the transport path supports 26. The lateral guiding, described above, of the transport wagons 20 in the straight transport path routes 10 to 16 represents only one of several possible designs. The straight transport path routes 10 to 16 could also be provided on the other longitudinal edges 28, parallel to the path, of the transport wagons 20 with corresponding guide strips 32, 34 for the guide rollers provided at that point on the transport wagons 20. Furthermore, the transport wagons 20 could be provided in the region of their corners with further guide rollers which rest on the inside of upwardly projecting guide strips of the transport path supports 26.

The four transport path routes 10 to 16 are connected to one another at a junction 36 in such a way that the transport wagons 20 from each of the four routes can optionally travel into one of the three other routes without stopping. The junction 36 is composed of two point modules 40 constructed according to the invention as T-shaped double points, the diverted point branches 42 of which are connected to each other and the coaxially opposite point branches 44, 46 of which are connected in each case to one of the transport path routes 10 to 16. The two point modules 40 are of identical construction and each has a base plate 48 with a running surface 40 which lies in the same plane as the running surfaces 24 of the transport path supports 26. Furthermore, the point modules 40 are provided with individual guide strips 52, 54, 56, 58 which are each provided with a guide groove 60 intended for engagement of the guide rollers 30 on the transport wagons.

The guide strips 52 to 58 are guided displaceably on the base plate 48 and are connected to actuators 62 (FIG. 3) which are provided for the preferably program-controlled displacement of the guide strips from an operating position into a non-functional side position and vice versa. In the point positions shown in FIG. 1, the guide strips 54 and 56 assume their non-functional side position, whereas the guide strips 58 are in the operating position and deflect the transport wagons 20, arriving on the transport path route 12, in the direction of the arrows A and B onto the transport path route 14, and vice versa. By appropriate displacement or adjustment of the guide strips 52 to 58, any desired travel path can be set among the transport path routes 10 to 16. For the smooth transition between the arriving transport path routes 10 to 16 and the guide strips 58 of the point modules 40 or between the point modules 40 themselves, non-adjustable guide strips 64 to 70 are attached to the base plates 48 of said point modules, which guide strips are provided with corresponding guide grooves to receive the guide rollers 30 of the transport wagons 20. Reverting to FIG. 1, the non-adjustable guide strips 68 and 70 carried by the diverted point branch 42 of one of the two point modules 40 are in alignment with and are mutual continuations of the non-adjustable respective guide strips 70 and 68 carried by the diverted point branch of the other of the two point modules 40. The diverted point branches of the two point modules are in an end-to-end orientation relative to one another. Furthermore, means are provided, as known and the not illustrated in detail, which lift from the running surface the running wheels of the transport wagons which lie in each case on the outer arc.

Figure 4:
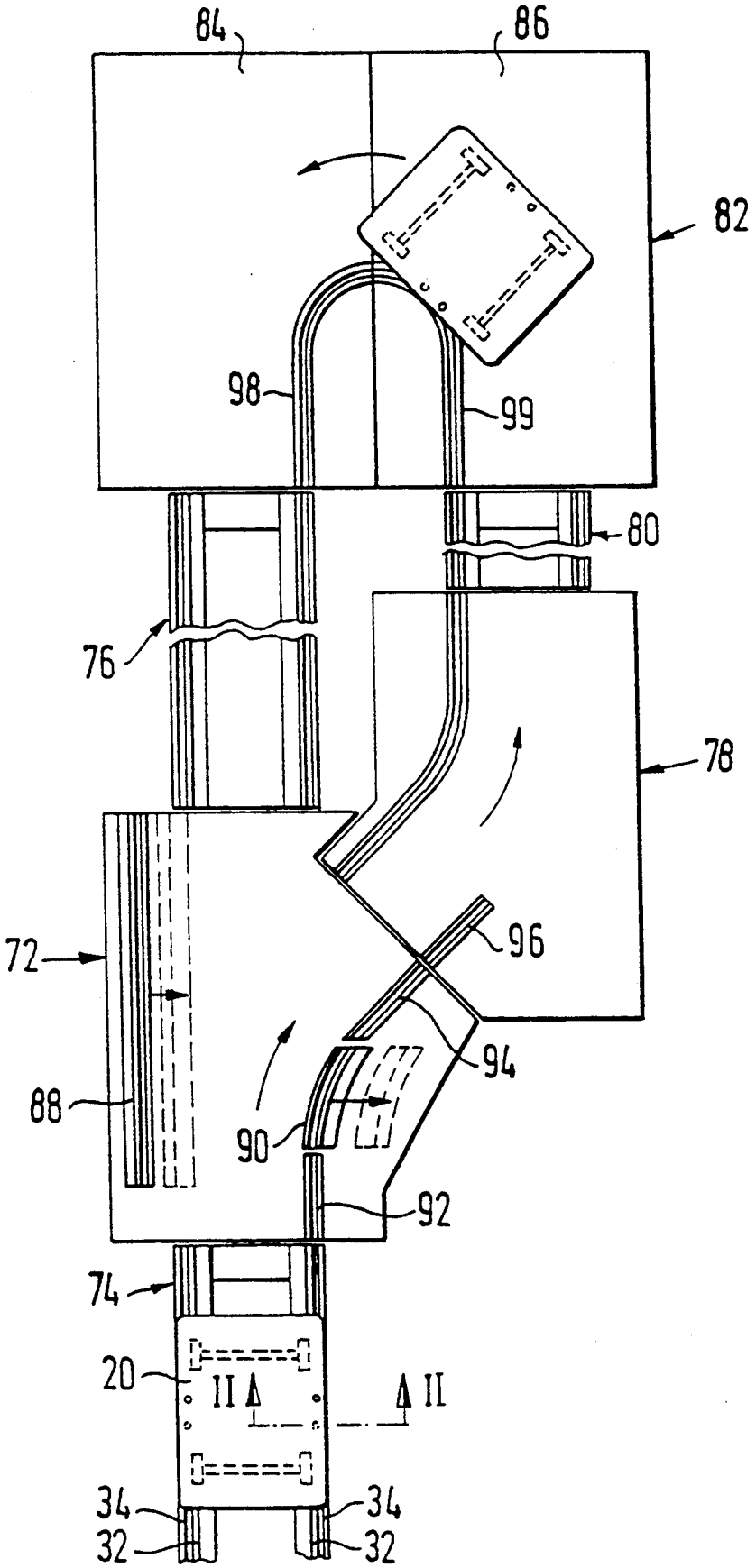
FIG. 4 is a top plan view of a second preferred embodiment, showing a partial region of a transport path system with a 45° point module and two route modules which are arranged adjacently in parallel with narrow spacing and which are connected to each other via a 180° deflection module.

In the transport path system according to FIG. 4 for transport wagons 20, a point module 72 is provided which connects a transport path route 74 to a transport path route 76, which is arranged coaxially to said transport path route 74, and to a parallel-running transport path route 80 via a counter-arc module 78. The two transport path routes 76, 80 are connected to each other via a reversing module 82 which is composed of two 90° arc modules 84,86. The transport wagons 20 and the straight transport path routes 74, 76, 80 are of identical construction to the corresponding parts of the embodiment of FIGS. 1, 2 and 3, but, in this case, the straight transport path routes are provided on both sides of the transport wagons 20 parallel to the path with guide strips 32, 34. The sectional diagram along the line II—II in FIG. 4 corresponds accordingly to the sectional diagram according to FIG. 2.

Mounted displaceably on a base plate of the point module 72 are two guide strips 88, 90 which can be shifted by an adjustment apparatus (not illustrated) from an operating position into a non-functional side position, and vice versa, the one guide strip assuming its operating position and the other its non-functional side position in each case. The guide strips 88, 90 are constructed in cross-section like the guide strips 52 to 58 of the first exemplary embodiment, cf. FIG. 3 of the drawing. For the smooth transition onto the guide strip 90, the point :module 72 is provided with fixed guide strips 92, 94. On the counter-arc module 78, the guide strip 96 lying on the outer arc is shortened in order not to impede the free swivelling of the running wheels 22 of the transport wagons 20. For the same reason, the 90° arc modules 84, 86 are only provided with guide strips 98, 99 on the inner arc.

According to the invention, the point module 72 has a branch angle of less than 90°, namely preferably 45°, which allows a narrower parallel spacing of the two transport path routes 76, 80 than the known point modules with a branch angle of 90°. A tight reversal loop, corresponding to the narrow parallel spacing of the transport path routes 76, 80, is formed by the direct abutment of two 90° arc modules. For some applications, it could also be advantageous to design the reversing module 82 in one part or to replace the two 90° arc modules by two adjacently arranged turning devices which each turn the transport wagons 20 by 90°. Furthermore, it may be advantageous to provide a transport path system, in addition to the point modules described according to the invention, with turning devices whose turning angle is greater than 90° or 180° and which join together a plurality of mutually approaching transport path routes in a freely selectable manner.

We claim:

1. In a transporting apparatus including a wagon, a transport path system and means for guiding the wagon on the transport path system; the improvement wherein said transport path system comprises (a) first and second longitudinally aligned, mutually spaced route modules;

(b) a third route module spaced from said first and second route modules and extending parallel thereto;

(c) a point module assembly coupling said first, second and third route modules to one another for causing the wagon to travel from said first route module to said second route module through said point module assembly or for causing the wagon to travel from said first route module to said third route module through said point module assembly; said point module assembly including (1) a point module having (i) two opposite ends coupled to said first and second route modules, respectively;

(ii) a first, linear wagon-guiding strip extending between said opposite ends and having operative and an inoperative position;

(iii) a second wagon-guiding strip extending from said first route module to an additional end of said point module; said second wagon-guiding strip having, at said additional end, a direction forming an angle of less than 90° with said first wagon-guiding strip; said second wagon-guiding strip including a curved strip portion having an operative and an inoperative position; and (2) a counter-arc module having (i) a first end arranged face-to-face with said additional end of said point module;

(ii) a second end connected to said third route module; and (iii) wagon-guiding strips defining a curved travel path from said first end of the counter-arc module to said third route module.

2. A transporting apparatus as defined in claim 1, further comprising a reversing module connected to said second and third route modules at a location spaced from said point module assembly; said reversing module including fixed wagon-guiding strips defining a travel path constituting a U-turn; said fixed wagon-guiding strips coupling said second and third route modules with one another.

3. A transporting apparatus as defined in claim 1, wherein said angle is 45°.

* * * * *